US006854930B2

(12) United States Patent
Pionetti

(10) Patent No.: US 6,854,930 B2
(45) Date of Patent: Feb. 15, 2005

(54) UNDERWATER PIPELINE CONNECTION JOINED TO A RISER

(75) Inventor: François-Régis Pionetti, Clichy (FR)

(73) Assignee: Saipem S.A., Montigny le Bretonneux (FR)

( * ) Notice: Subject to any disclaimer, the term of this patent is extended or adjusted under 35 U.S.C. 154(b) by 0 days.

(21) Appl. No.: 10/480,493

(22) PCT Filed: Jun. 12, 2002

(86) PCT No.: PCT/FR02/02002

§ 371 (c)(1),
(2), (4) Date: Dec. 10, 2003

(87) PCT Pub. No.: WO02/103153

PCT Pub. Date: Dec. 27, 2002

(65) Prior Publication Data

US 2004/0156684 A1 Aug. 12, 2004

(30) Foreign Application Priority Data

Jun. 15, 2001 (FR) ..... 01 07893

(51) Int. Cl.[7] ..... E21B 17/01

(52) U.S. Cl. ..... 405/172; 405/169; 405/224.3; 166/346; 166/367

(58) Field of Search ..... 405/172, 169, 405/224.2, 224.3; 166/344, 345, 346, 367

(56) References Cited

U.S. PATENT DOCUMENTS

| | | | | | |
|---|---|---|---|---|---|
| 3,517,737 | A | * | 6/1970 | Petersen | 166/344 |
| 3,782,458 | A | | 1/1974 | Slack | |
| 4,529,334 | A | | 7/1985 | Ortloff | |
| 4,906,137 | A | * | 3/1990 | Maloberti et al. | 405/224.3 |
| 6,109,833 | A | * | 8/2000 | Savy | 405/169 |

FOREIGN PATENT DOCUMENTS

| | | |
|---|---|---|
| FR | 507.672 | 12/1919 |
| WO | WO 97/25561 | 7/1997 |
| WO | WO 00/49267 | 8/2000 |

* cited by examiner

*Primary Examiner*—Frederick L. Lagman
(74) *Attorney, Agent, or Firm*—Cohen, Pontani, Lieberman & Pavane

(57) ABSTRACT

The present invention relates to an installation providing a bottom-to-surface connection for an undersea pipe resting on the sea bottom, in particular at great depth, the installation being of the hybrid tower type having a static base placed on the sea bottom. In the installation of the present invention, said pipe resting on the sea bottom is connected by a flexible pipe element constituting a bend to a vertical riser whose bottom end is held in fixed position relative to said base.

17 Claims, 9 Drawing Sheets

UNDERWATER PIPELINE CONNECTION JOINED TO A RISER

PRIORITY CLAIM

This is a U.S. national stage of application No. PCT/FR02/02002, filed on 12 Jun. 2002. Priority is claimed on that application and on the following application: Country: France, Application No.: 01/07893, Filed: 15 Jun. 2001.

FIELD OF THE INVENTION

The present invention relates to a bottom-to-surface connection installation for at least one undersea pipe installed at great depth, the installation being of the hybrid tower type.

The technical field of the invention is the field of making and installing vertical production columns for extracting oil, gas, or other soluble or meltable material or a suspension of mineral material from an undersea well head for use in developing production fields installed in the sea, off shore. These columns are known as "risers". The main and immediate application of the invention lies in the field of oil production.

BACKGROUND OF THE INVENTION

In general, a floating support has anchor means for keeping it in position in spite of the effects of currents, winds, and swell. It also generally comprises means for storing and processing oil and means for transferring it to offloading oil tankers, which call at regular intervals to offload production. Such floating supports are referred to below by the acronym "FPSO" which stands for floating production storage offloading.

Because of the multiplicity of lines that exist in that type of installation, it has been necessary to implement bottom-to-surface connections of the hybrid tower type in which substantially vertical rigid pipes referred to herein as "vertical risers" provide connections between undersea pipes resting on the sea bottom and rise up a tower to a depth that is close to the surface, and from this depth flexible pipes provide connections between the tops of the towers, i.e. the tops of the vertical risers, and the floating support. The tower is then provided with buoyancy means so as to remain in a vertical position and the risers are connected at the foot of the tower to undersea pipes via rigid sleeves for absorbing the vertical movements of the tower. Overall the assembly is commonly referred to as a "hybrid tower" since two technologies are involved, firstly a vertical portion or tower proper in which the riser is constituted by rigid pipes, and secondly the top portion of the riser which is constituted by pipes in a catenary configuration for providing a connection with the floating support.

French patent No. FR 2 507 672 published on Dec. 17, 1982 and entitled "Colonne montante pour les grandes profondeurs d'eau" [A riser for great depths] describes one such hybrid tower.

The present invention relates more particularly to the known field of connections of the type comprising a vertical hybrid tower anchored to the sea bottom and comprising a float situated at the top of a vertical riser, which is in turn connected via a pipe and in particular a flexible pipe that takes up a catenary configuration under the effect of-its own weight on going from the top of the riser to a floating support on the surface.

The advantage of such a hybrid tower lies in the ability of the floating support to depart from its nominal position while inducing minimal stresses on the tower or on those portions of the pipe that take up a suspended catenary configuration, whether underwater or on the surface.

Patent publication WO 00/49267 in the name of the present Applicant discloses a tower whose float is at a depth that is more than half the depth of the water and in which the catenary connection to the surface vessel is in the form of thick-walled rigid pipes. At its base, the tower described in that document requires flexible connection sleeves enabling the bottom ends of the vertical risers of said tower to be connected to the undersea pipes resting on the bottom in order to absorb the movements that result from expansion due to the temperature of the fluid being transported.

More particularly, in WO 00/49267, the anchor system comprises a vertical tendon constituted either by a cable or by a metal bar or indeed by a pipe held under tension at its top end by a float. The bottom end of the tendon is fixed to a base resting on the bottom. Said tendon has guide means distributed all along its length, and through which said vertical risers pass. Said base can merely be placed on the sea bottom and can remain in place under its own weight, or it can be anchored by means of piles or any other device suitable for holding it in place. In WO 00/49267, the bottom end of the vertical riser is suitable for being connected to the end of a curved sleeve that can be moved between a high position and a low position relative to said base, from which said sleeve is suspended and associated by return means urging it towards the high position in the absence of a riser. This mobility of the curved sleeve serves to absorb variations in riser length due to the effects of temperature and pressure. At the head of the vertical riser, an abutment device secured thereto bears against the support guide installed at the head of the float, thereby holding the entire riser in suspension.

In addition, since the crude oil is conveyed over very long distances, e.g. several kilometers, it is desirable to provide an extreme degree of insulation both to reduce any increase in viscosity which would lead to a reduction in the hourly production rate of a well, and secondly to avoid any blockage of the flow by deposition of paraffin or by the formation of hydrates once the temperature drops to around 30° C.–40° C. These phenomena are particularly troublesome in West Africa where the temperature of the sea bottom is about 4° C. and where crude oils are of the paraffin type.

Numerous thermal insulation systems are known which enable the required level of performance to be achieved while withstanding pressure at the bottom of the sea which can be about 150 atmospheres at a depth of 1500 meters (m). Amongst the various concepts available, mention can be made of the "pipe-in-pipe" system comprising a pipe conveying the hot fluid which is installed inside an outer protective pipe, with the space between the two pipes being either merely filled with an insulating substance which is optionally vacuum confined, or else the space can merely be evacuated. Numerous other kinds of material have been developed for providing high temperature insulation, some of which are also capable of withstanding high pressure, merely surrounding the hot pipes and generally being confined within a flexible or rigid outer casing, itself in pressure equilibrium and having the main function of ensuring that the geometrical shape of the material remains substantially constant over time.

All of those devices for conveying a hot fluid within an insulated pipe present differential expansion phenomena to some extent. The inner pipe is generally made of steel and is at a temperature which it is desired to keep as high as possible, e.g. 60° C. or 80° C., while the outer casing, often likewise made of steel, is at the temperature of sea water, i.e. around 4° C. The forces generated on the elements providing interconnection between the inner pipe and the outer casing are considerable and can reach several tens or even several hundreds of (metric) tonnes, and the resulting total elongation is about 1 m to 2 m for insulated pipes that are 1000 m to 1200 m in length.

OBJECTS AND SUMMARY OF THE INVENTION

The problem posed by the present invention is to be able to make and install such bottom-to-surface connections for undersea pipes at great depths, e.g. at depths of more than 1000 m, said connections being of the type comprising a vertical tower in which the fluid being conveyed must be maintained at a temperature above some minimum temperature until it reaches the surface, by minimizing components that are subjected to heat losses, and while avoiding the drawbacks that are created by absolute or differential thermal expansion of the various components of said tower, so as to be able to withstand the extreme stresses and the fatigue phenomena that accumulate over the lifetime of the installation, which can commonly exceed 20 years.

Another problem of the present invention is to provide a bottom-to-surface connection installation of the hybrid tower type in which the anchor system is very strong and low in cost, and for which the method of installing the various components elements is greatly simplified and likewise of low cost.

A particular object of the present invention is to provide an installation which can be fully prefabricated on land, in particular in terms of interconnecting the rigid pipes that are to make up said pipes that rest on the sea bottom and that make up said vertical risers.

More particularly, another object of the present invention is to provide an installation which can be installed on the sea bottom without requiring any automatic connectors and preferably without requiring any flexible ball joints in the bottom portion of the tower. Automatic connectors are connectors in which locking between the male portion and the complementary female portion is designed to take place very simply at the bottom of the sea using a robot under the control of a remotely-operated vehicle (ROV) without requiring any direct manual intervention. Such automatic connectors and flexible ball joints are very expensive.

Another problem behind the invention is that of providing an installation which makes it possible to take action on the inside of the undersea pipe resting on the sea bottom using a "coiled-tubing" type method from the surface, and from the top end of the vertical riser.

A solution to the problems posed is thus a bottom-to-surface connection installation for an undersea pipe resting on the seabed, in particular at great depth, in which said undersea pipe resting on the bottom is connected to a said vertical riser by means of at least one flexible pipe element held by a base, and comprising more particularly:

1) at least one vertical riser connected at its bottom end to at least one undersea pipe resting on the sea bottom, and at its top end to at least one float;
2) preferably at least one connection pipe, more preferably a flexible pipe, providing the connection between a floating support and the top end of said vertical riser; and
3) the connection between the bottom end of said vertical riser and a said undersea pipe resting on the sea bottom is provided by means of an anchor system comprising a base resting on the bottom, wherein:
   a) the bottom end of the vertical riser is connected to the end of the pipe resting on the sea bottom by means of at least a first flexible pipe element which is curved to form a bend; and
   b) said base comprises a platform resting on the seabed and a superstructure secured to said platform and holding in position both said end of the undersea pipe resting on the sea bottom and said end of said vertical riser connected to said first flexible pipe element, whereby:
      the end of said first flexible pipe element connected to the bottom end of the vertical riser is held in a position that is fixed relative to said base; and
      the axes (XX', YY') of said ends of said undersea pipe resting on the sea bottom and of said vertical riser are preferably held in a common plane perpendicular to said platform.

The term "flexible pipe element" is used to mean the following pipe elements:

flexible pipes known to the person skilled in the art in the technical field of the invention as mentioned above and specifically, in the field of technologies for extracting undersea oil in particular, the flexible pipes used for making connections between a floating support and the top end of a rigid pipe constituting said vertical riser.

Such flexible pipes are conventionally constituted by an inner tube of flexible polymeric material reinforced by braided metal wire reinforcement forming spiral-wound sheaths. Such flexible pipes are capable of withstanding considerable internal or external pressures, possibly reaching and exceeding 100 megapascals (MPa), while accommodating a very great amount of dynamic or static flexing, i.e. presenting a radius of curvature that is very short, possibly ten times or even only five times their diameter. That type of hose is manufactured and sold by Coflexip-France.

And more generally, any pipe of rigidity that is low compared with the rigidity of the steel pipes or the rigid composite material pipes that constitute said risers, and in particular low rigidity pipes of the kind described in WO 97/25561 which comprises a rigid tubular outer metal wall having slots or grooves extending along a helical path in the surface of said outer wall, said outer wall containing an inner pipe of corrugated metal that provides leaktightness while being capable, because of its corrugated shape and its low wall thickness, of flexing in a manner similar to pipes made of polymeric plastics material. The slots or grooves made in the rigid metal pipes constituting the outer tubular wall enable said outer wall to be given a similar degree of flexibility, even though they are not as flexible as a hose proper. However, manufacture is much simpler to perform, so cost price is only a small fraction of that of an equivalent hose. A hose having a length of a few meters requires end fittings that are extremely expensive because they are difficult and to assemble, whereas the low rigidity pipes disclosed in patent WO 97/25561 can be manufactured from a steel tube blank similar to that used for the adjacent rigid pipes, thus enabling it to be joined thereto merely by welding.

Said first low rigidity or flexible pipe element thus curves to form an upwardly-facing bend, and its curvature is held in a plane that is substantially vertical when said platform rests substantially horizontally on the sea bottom.

The term "bend" is used herein to mean two short rectilinear sections of pipe that are at 90° to each other, and that are interconnected by a curved section which, at rest, forms a circular arc, preferably having a radius of curvature of less than 10 m, and more particularly lying in the range 5 m to 10 m. This can be done using a section of length 7.5 m to 15 m to constitute said first flexible pipe element.

In WO 00/49267, the tower having a plurality of risers is tensioned by a central tendon which holds a plurality of vertical risers in suspension, and the top of the tendon as tensioned by a float constitutes a reference point of substantially fixed vertical position, ignoring variation due to the total apparent weight of the risers and their contents. All movement is therefore absorbed by the curved connection sleeves at the bottom, which parts are expensive and difficult to make and to install. In the present invention, the point at a substantially fixed vertical position is at the bottom of the tower, at the bottom end of the riser where it connects with said first flexible pipe element, thus making it possible to eliminate the curved connection sleeves, and differential movement between the risers is absorbed by the float(s) free to move vertically at the top of each riser.

Said connection pipe between the floating support and the top end of the vertical riser can be:

a reduced rigidity or flexible pipe if the head float is close to the surface; or a rigid pipe if the head float is at great depth.

In a preferred embodiment of the invention:

a) at its bottom end, said vertical riser has a terminal portion of rigid pipe connected to the top portion of said vertical riser via a second flexible pipe element, allowing said top portion to move through an angle $\alpha$ relative to said rigid terminal portion of pipe; and b) said base has a superstructure which holds said rigid terminal portion of pipe of said vertical riser rigidly in a fixed position relative to the base, the end of said portion being connected to said first flexible pipe element.

The axis of said rigid pipe portion is thus substantially vertical and therefore fixed when it is held in position by said superstructure, said axis preferably being perpendicular to said platform.

This preferred embodiment including a second said flexible pipe element makes it possible to avoid using any ball-and-socket type flexible joint.

Nevertheless, in another embodiment, it is possible to use such a flexible joint instead of said second flexible pipe element. A flexible joint allows for a large amount of variation in the angle $\alpha$ between the axis of the tower and the axis of the vertical portion of the riser that is secured to the base without generating significant stresses in the portions of pipe that are situated on either side of said flexible joint. In conventional manner, the flexible joint can either be a generally spherical ball associated with sealing gaskets, or else it can be a laminated "ball" made up of a stack of sheets of elastomer and of interleaved sheets of metal bonded to the elastomer, and capable of absorbing large amounts of angular movements by deforming the elastomer sheets, while nevertheless conserving complete leaktightness because of the absence of any sliding gaskets.

In a particular embodiment, said base has fixing supports suitable for holding the end of said undersea pipe resting on the bottom in a position that is fixed relative to the base.

In this embodiment, said first flexible pipe element in the bend zone is of controlled shape that is well stabilized, with locking at the coupling between the vertical riser and said first flexible element taking up all of the vertical tension created by the float at the head of the riser, which tension can be as much as 100 tonnes. The first flexible pipe element therefore no: longer supports any movement or force whether from the pipe resting on the bottom or from the vertical riser.

Nevertheless, in a preferred embodiment, said base further includes guide elements to allow the end of said undersea pipe resting on the bottom to move in translation longitudinally along its own axis XX'.

Said guide means prevent all movement in translation in any other direction, i.e. in a direction having a vertical component YY' and/or a lateral component ZZ'.

In this second embodiment, the shape of the bend remains under control even though it is not completely stabilized.

More particularly, said guide elements include sliding skids or rollers against which said end of the pipe resting on the bottom can slide in longitudinal translation along the axis XX' of said end, thereby avoiding transferring thrust forces to the base, which forces are due to the downhole effect (internal pressure in the pipe), and to thermal expansion of said pipe.

In this second embodiment in which the end of the undersea pipe resting on the bottom can move longitudinally along its axis, it will be understood that this movement deforms the bend of said first flexible pipe element. Nevertheless, movement of the end of the pipe resting on the bottom occurs only exceptionally and then only under the effect of thrust caused by said pipe expanding due to variations in the temperature and/or pressure of the internal fluid it is conveying. In general, this movement does not exceed 1 m to 2 m.

In a particular embodiment, said base comprises a said superstructure secured to a said platform, in which said superstructure forms a bracket standing on said platform, said platform preferably being secured to said guide means that are preferably constituted by rollers distributed on either side of the base of said bracket where it stands on said platform, and said bracket having a latch in its portion that is held above said platform, the latch being constituted in particular by a clamping collar or flange type arrangement serving to lock said bottom end of said riser.

Said guide means preferably also include anti-rotation devices to prevent the end of the pipe turning about its longitudinal axis XX'. The anti-rotation devices thus serve to ensure any twisting phenomena that might be generated by the undersea pipe during expansion or contraction movements of the undersea pipe under the effect of pressure or temperature is not transferred to the flexible structure of said first flexible pipe element in the shape of a bend.

Thus, the anti-rotation device prevents the bend-shaped flexible portion from being twisted during said expansion and contraction movements of the undersea pipe.

In a preferred embodiment, said base comprises a said superstructure secured to a said platform, in which said superstructure forms a bracket standing on said platform, said platform preferably being secured to said guide means that are preferably constituted by rollers distributed on either side of the base of said bracket where it stands on said platform, and said bracket having a latch in its portion that is held above said platform, the latch being constituted in particular by a clamping collar or flange type arrangement serving to lock said bottom end of said riser.

Said base preferably comprises a platform which cooperates with stabilizer elements comprising deadweights placed on said platform and/or suction anchors passing through said platform to be driven into the ground.

The installation of the present invention is advantageous in that the hybrid tower can be prefabricated almost completely on land and then towed to its site, and once the base has been stabilized by deadweights or by suction anchors, the riser portion is put into a substantially vertical position merely by filling the head float with gas, or indeed by hoisting from the surface, thereby avoiding any need to use automatic connectors and flexible ball-and-socket joints, which are essential in the prior art.

Another advantage of the present invention also lies in a considerable reduction in overall cost which results from omitting any flexible joint and any automatic connector between the various portions of pipe, and also omitting the curved sleeves used in the prior art for connecting together the vertical riser and the pipe that rests on the sea bottom, which items can amount to more than 25% of the total cost of a prior art installation. In the prior art, such a curved sleeve is complex to make since after the end of the pipe resting on the sea bottom has been placed on the seabed and after the base has been installed, each of which is located in a target zone constituting a respective circle with a diameter of about 5 m to 10 m, giving considerable uncertainty as to their relative positions, it is necessary to measure their relative positions and orientations using an ROV, after which the sleeve is made on land or on board the installation vessel, and is then put into place using an ROV. In addition, such a sleeve requires connection means, generally two automatic connectors, one at each end of the sleeve, for interconnecting the vertical riser and the pipe resting on the sea bottom. Finally, it should be specified that effective thermal insulation of such a curved sleeve fitted with automatic connectors as used in the prior art is extremely difficult to provide, and thus very expensive, thereby considerably increasing the cost and the complexity of the installation when pipes are used for which it is desirable to obtain extremely good installation.

The installation of the invention makes it possible to eliminate all of those elements of the prior art, i.e. the connection sleeves, the automatic connectors, and the flexible ball-and-socket joints, and to provide a riser tower integrating the higher performance insulation technologies at better cost.

Finally, in WO 00/49267, the fact that the end of the pipe resting on the bottom is located in a target zone that is spaced apart from the base of the tower makes it necessary to install prefabricated sleeves made up of a succession of rectilinear portions and of bends through various angles in order to connect the end of the pipe resting on the bottom to the base of the tower. Such sleeves are expensive and difficult to install and they give rise to cold points that harm good thermal insulation.

The installation of the invention thus makes it possible to eliminate all of those drawbacks of the prior art and to provide, at lower cost, a riser tower that integrates insulation technologies having the highest performance.

In an embodiment, the installation of the invention comprises:

- at least two of said vertical risers that are substantially parallel and close together, each being connected at its top end to at least one respective float;
- at least two said undersea pipes resting on the sea bottom;
- said base holding the bottom ends of said vertical risers in fixed positions relative to said base; and
- said installation having at least two of said flexible pipe elements connecting the ends of the undersea pipes resting on the sea bottom to said bottom ends of said vertical risers.

More particularly, said two undersea pipes resting on the sea bottom are assembled as a bundle within a common flexible protective casing, thus enabling an insulating material, preferably paraffin or a gel compound to be confined around said pipes.

More particularly still, in the installation of the invention:

- at least two of said undersea pipes resting on the sea bottom are assembled together as a bundle in a common flexible protective casing enabling an insulating material, preferably paraffin or a gel compound to be confined around said pipes; and
- at least two of said vertical risers are assembled together to constitute a bundle within a common flexible protective casing enabling an insulating material, preferably a paraffin or a gel compound to be confined around said risers;
- the connection of each individual pipe in the bundle between a pipe of the bundle resting on the bottom and the corresponding pipe in the vertical bundle being constituted by at least one of said first flexible pipe elements, preferably preinstalled on land during manufacture in continuity of said individual rigid pipes.

In another embodiment, said vertical risers are not assembled in a bundle, and in order to facilitate differential movements between risers, first and second vertical risers that are not assembled in a bundle are held substantially parallel by means of a sliding connection system that allows first and second risers to move axially relative to each other, said connection system comprising a tubular collar fixed around said first riser, said collar being rigidly connected to a tubular ring that slides freely along said second riser. The sliding connection system preferably comprising two systems, one on each riser, each system comprising a plurality of said collars distributed along the corresponding riser in alternation with the rings of the other system. The sliding connection system enables the risers to move vertically but not transversely, i.e. they remain substantially equidistant in a plane perpendicular to their axes.

In a particular embodiment, the top portion of said vertical riser above said second flexible pipe element comprises a system of insulated pipes constituted by a set of two coaxial pipes comprising an inner pipe and an outer pipe, an insulating fluid or material, preferably a, phase-change material of the paraffin type or a gel compound, being placed between said two pipes, or else a high vacuum is maintained between them.

Since the junctions between the various components constituting the float, the flexible pipes, and the vertical riser are situated not far below the surface, they are subjected to the combined effects of swell and current. More particularly, since the surface support is subjected not only to swell and to current, but also to the effects of winds, the movements of the assembly give rise to considerable forces in the various mechanical components constituting the singular point that is the junction between the riser and the flexible pipe. The float exerts upward vertical traction that can lie in the range several tens of tonnes to several hundreds of tonnes, and may exceed 1000 tonnes, depending on the depth of the water which may be as much as 1500 m, or even 3000 m, and depending on the inside diameter of the pipe which can lie in the range 6 inches (") to 14", or even 16". Thus, the forces to be transmitted are considerable and the movements of the assembly are cyclical at the rate of the swell amongst other things, i.e. with a period in rough weather that typically lies in the range 8 seconds (s) to 20 s. The fatigue cycles as accumulated over the lifetime of an oil field can thus reach values that exceed several tens of millions of cycles. That is why an installation of the present invention advantageously comprise at least one float, and preferably a group comprising a plurality of floats installed at the top of the at least two said vertical risers, and arranged in such a manner that said floats are held together by means of a structure that supports them while allowing relative vertical movement between said groups of floats, and in particular movements due to differential expansion. Said floats are thus free to move vertically but they are spaced far enough apart so that during deformation of their support structures, any physical contact between the groups of floats is avoided.

Another problem of the present invention is to make it easy to take action on the inside of said riser from the surface, particularly in order to inspect or clean a said vertical riser by including a rigid tube extending from the top end of the float and passing through said connection device between the float and the vertical riser.

These bottom-to-surface connections convey a multiphase fluid, i.e. a fluid made up of crude oil, water, and gas. However, as the fluid rises, local pressure decreases and bubbles of gas therefore increase in volume, giving rise to phenomena of instability in the stream of fluid which can lead to shocks of considerable magnitude. During pauses in production, the gas collects in the top portion and the oil-water mixture becomes trapped in low portions, i.e. in the bottom portion of the flexible catenary zone, and also in the bottom portion of the substantially vertical section of the riser.

When the temperature of the multiphase mixture made up of crude oil, water, and gas, drops below a value lying in the range 30° C. to 40° C., the mixture tends to give rise to two types of plug that can block production. A first type of plug is due to hydrates forming from the gas phase in the presence of water, and another type of plug is due to freezing of the paraffin that is contained in varying proportions in crude oil from certain oil fields, particularly those in West Africa.

A method of taking action on the inside of pipework, known as the "coiled-tubing" method, consists in pushing a rigid tube of small diameter, generally lying in the range 20 millimeters (mm) to 50 mm, along the pipe. Said rigid tube is stored merely by being wound on a drum, and is untwisted on being wound off the drum. Said tube can comprise several thousands of meters in a single length. The end of the tube situated on the core of the storage drum is connected via a rotary joint to a pump unit capable of injecting liquid at high pressure and at high temperature. Thus, by pushing the tube along the pipe, while maintaining pumping and counterpressure, said pipe can be cleaned by injecting a hot substance capable of dissolving plugs. That method of taking action is commonly used when acting on vertical wells or on pipes that have become obstructed by the formation of paraffin or hydrates, which phenomena are commonplace and to be feared in all installations that produce crude oil. The "coiled-tubing" method is also referred to herein as the continuous tubing method.

The installation of the invention comprises a connection device between said float and the top end of said riser, the device comprising:

- a third flexible pipe element whose ends are connected in non-hinged manner respectively to the under-surface of said float and to the top end of said vertical riser; and
- the connection of said third flexible pipe to the top end of said riser taking place via a swanneck-shaped device, which swanneck-shaped device also provides the connection between said riser and a said connection pipe connected to the floating support, preferably a said flexible connection pipe;
- said third flexible pipe preferably being extended through said float by a rigid tubular pipe passing right through the float so as to make it possible to take action on the inside of said vertical riser from the top portion of the float through said rigid tubular pipe, then through said connection device constituted by said third flexible pipe and then through said swanneck-device so as to access the inside of said riser and clean it by injecting liquid and/or by scraping the inside wall of said riser, and then said undersea pipe resting on the sea bottom.

The swanneck-shaped device has a top straight portion providing the junction between said vertical riser and said third flexible pipe-connected to said float. On this straight portion of the swanneck-shaped device, a bend-forming curved branch serves to provide the junction between the end of said vertical riser and the end of said flexible pipe which is in turn connected to said floating support. The ends of said curve are substantially tangential to the catenary curve constituted by said flexible pipe which provides the connection with the floating support, and they are substantially tangential to said straight portion of the swanneck-shaped device.

The main advantage of the installation of the invention is that all of the elements are prefabricated on land prior to being installed. They can thus be assembled together in a dummy run in order to verify that all of the elements are co-operating properly, including the locking means. Thus, assembly of the installation is considerably simplified and the operating time on installation ships is minimized. In the prior art, the undersea pipes were put into place, and then after the risers had been installed, curved connection sleeves needed to be made after taking very accurate measurements using ROVs. Such sleeves, whether prefabricated on land or on site, can have dimensions of several tens of meters and they need to be installed using the same ROV, thereby requiring a considerable amount of time and thus representing very high cost because of the sophistication of specialist installation ships. The savings achieved by the device and the method of the invention amount to several days of installation ship time and also to eliminating the automatic connectors that are essential at each end of a prefabricated sleeve, thus representing a considerable saving in cost.

The objects of the present invention are thus also achieved by a method of installing an installation, said method comprising steps in which:

1) the following are preassembled in succession end to end said pipe for resting on the sea bottom; said first flexible pipe element; said rigid pipe for constituting said vertical riser; and, where appropriate and preferably, said second flexible pipe element;
2) a said base is put into place co-operating with the assembly obtained in step 1), whereby:
   said pipe for resting on the sea bottom and said rigid pipe for constituting said vertical riser are fixed to said platform, preferably close to the ends of said pipes that are connected to said flexible pipe elements; and
   the end of said first flexible pipe element connected to the bottom end of said vertical riser is not held by said superstructure of the base;
3) the assembly obtained after step 2 is towed to the desired site;
4) said base is put on the sea bottom and stabilized, preferably with said stabilizing elements;
5) said base is separated from said riser; and
6) said bottom end of said riser is connected with said superstructure of the base so as to be held in said fixed vertical position relative to the base.

BRIEF DESCRIPTION OF THE DRAWINGS

Other characteristics and advantages of the present invention appear in greater detail in the light of the following embodiments described with reference to FIGS. 1 to 11.

DETAILED DESCRIPTION OF THE PRESENTLY PREFERRED EMBODIMENTS

Figure 1:
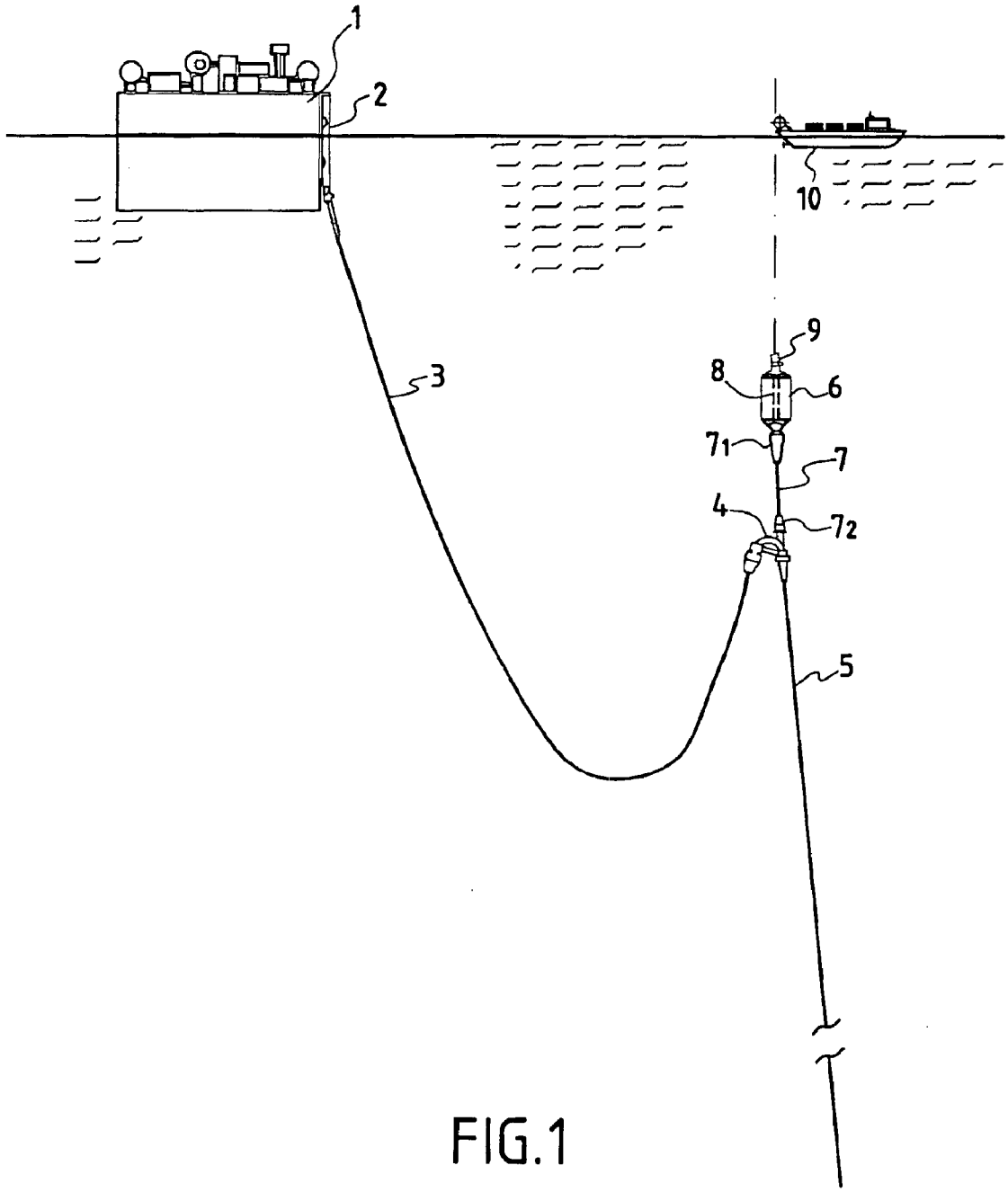
FIG. 1 is a section view through the top portion of a hybrid tower connected to a floating support of the FPSO type, with a service vessel being shown performing a maintenance operation vertically above said tower.

FIG. 1 shows a bottom-to-surface connection installation for an undersea pipe 11 resting on the sea bottom, in particular at great depth:

a) at least one vertical riser 5 having its bottom end connected to at least one undersea pipe 11 resting on the sea bottom (not shown), and at its top end to at least one float 6; and b) at least one connection pipe 3, preferably a flexible pipe, providing the connection between a floating support 1 and the top end of said vertical riser 5.

Figure 2:
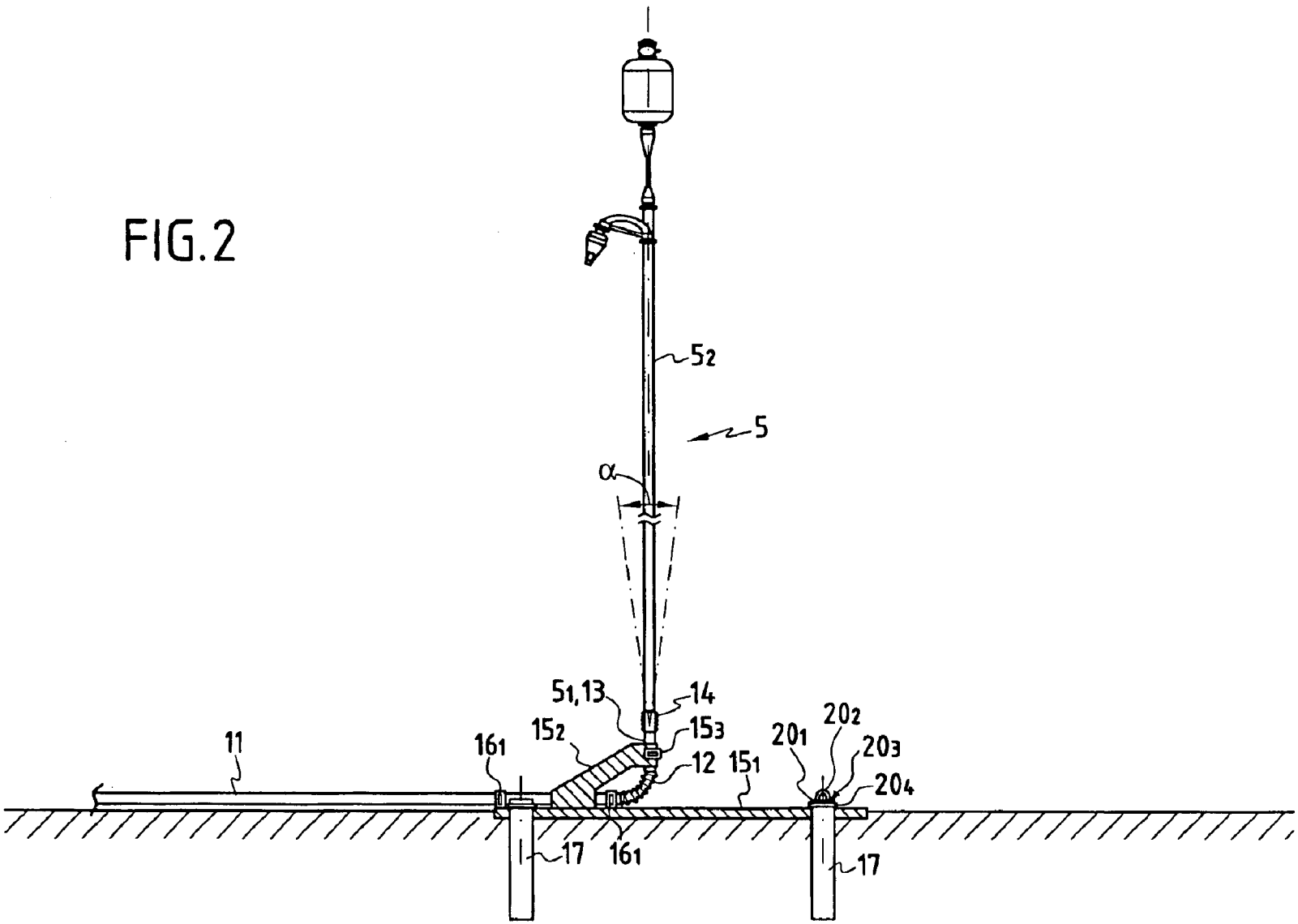
FIG. 2 is a side view of the same tower of the present invention shown in its final configuration, after its based has been stabilized, the vertical riser has been tensioned, and the intermediate portion has been locked.

FIG. 2 shows an installation of the invention with a tower in the vertical position relative to a base resting on the bottom. The base comprises a platform $\mathbf{15}_1$ constituted by a flat support placed on the sea bottom, of a length which can lie in the range 30 m to 50 m, for example, and of a width in the range 5 m to 10 m. The base carries a bracket-shaped superstructure $\mathbf{15}_2$ upstanding on the platform $\mathbf{15}_1$ and of a height which can exceed 10 m, for example.

Said bracket $\mathbf{15}_2$ secured to said platform, is constituted by a structure placed astride the end of the undersea pipe 11 resting on the sea bottom. The undersea pipe 11 resting on the sea bottom is secured to the platform $\mathbf{15}_1$ by conventional clamping collar or flange type fixing supports $\mathbf{16}_1$ which hold it in fixed position relative to the base. These fixing supports $\mathbf{16}_1$ placed on said platform are spaced apart from each other by several meters so as to cause the end of said pipe to be rigidly fixed to said platform. The bottom end of the vertical riser 5 comprises a portion of rigid pipe 13, e.g. of the type used for the main portion of the vertical riser which is made of steel.

Figure 3:
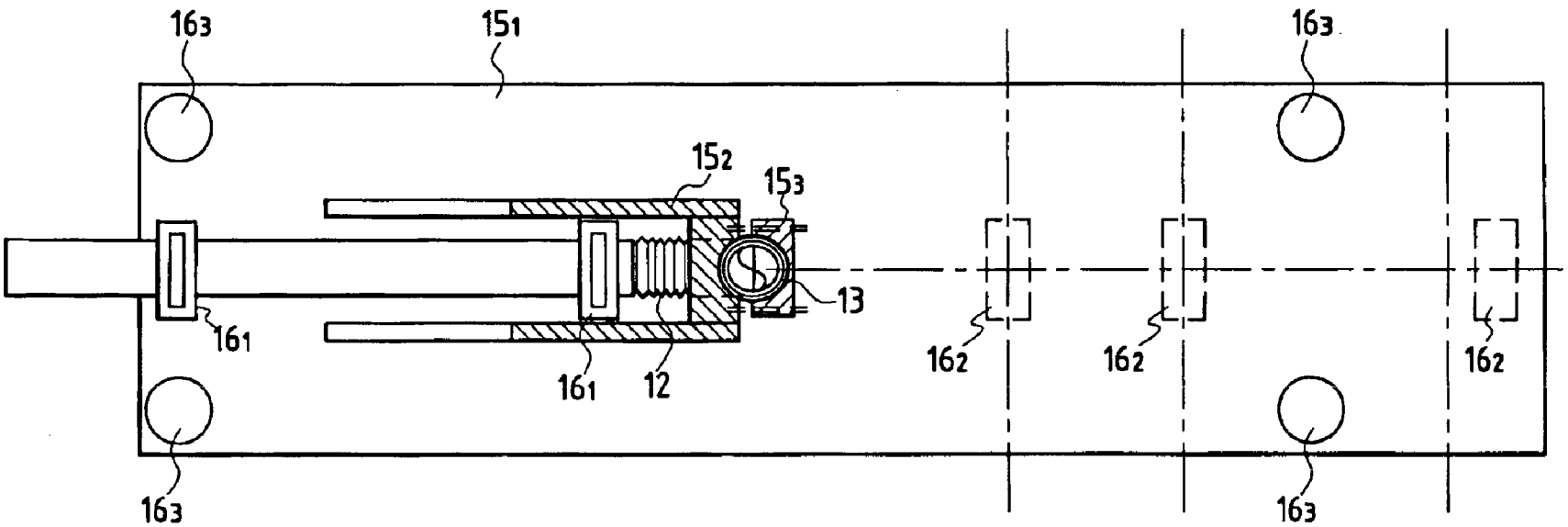
FIG. 3 is a plan view corresponding to FIG. 2.

The bottom end $\mathbf{5}_1$ of the vertical riser 5 and constituted by a portion 13 of rigid pipe as in the embodiment of FIG. 2 is held in fixed position at the top of the bracket $\mathbf{15}_2$. This terminal portion of the rigid pipe 13 is secured to the top of the bracket $\mathbf{15}_2$ by means of a conventional clamping collar $\mathbf{15}_3$ as shown in FIG. 3, said clamping collar being locked by bolts (not shown) put into place and locked by the ROV of the installation, i.e. an automatic submarine robot that is controlled from the surface.

The clamping collar is dimensioned so as to take up all of the vertical forces on the riser, which can be great at 100 tonnes.

The bottom end of the rigid vertical terminal portion of pipe 13 secured to the top end of the bracket $\mathbf{15}_2$ and the end of the undersea pipe 11 resting on the sea bottom and passing through the bottom of the bracket extend substantially at right angles to each other and are interconnected by a first flexible pipe element 12. Said first flexible element is thus suspended from the top of the bracket or the upstanding portion of the bracket and presents a bend substantially at right angles.

This first flexible pipe element 12 is constituted by a length of a unitary flexible pipe element of the same type as is used for the flexible pipe connection 3 between the floating support and the head 4 of the riser, or preferably of the type described in WO 97/25561.

In FIG. 2, the base is stabilized by suction anchors 17 which are well adapted for taking up the thrust forces exerted on the base structure, as generated by variations in the pressure and the temperature of the fluid inside the undersea pipe 11 resting on the sea bottom. Said suction anchors 17 are driven in through orifices $\mathbf{16}_3$ in said platform $\mathbf{15}_1$. They are constituted by pipe portions disposed perpendicularly to the base passing through said orifices $\mathbf{16}_3$. These pipe portions have open bottom ends while their top ends $\mathbf{20}_1$ are closed in leaktight manner so that each pipe forms a large-diameter bell of generally elongate shape. Such anchors 17 can have a diameter of several meters and a height of 20 m to 30 m or even more. Each can weigh 15 tonnes to 50 tonnes, or even more.

A second flexible pipe element 14 provides the connection between the top or "main" portion $\mathbf{5}_2$ of the vertical riser and the top end of said terminal portion of rigid pipe 13 held securely to the top of the bracket $\mathbf{15}_2$. This second flexible pipe element 14 allows the top portion $\mathbf{5}_2$ of the riser to move angularly relative to the axis YY' of the terminal portion of rigid pipe 13 constituting the bottom portion $\mathbf{5}_1$ of the riser and fixed in position relative to the bracket.

The two flexible pipe elements 12 and 14 perform different functions. The first flexible pipe element 12 must be very flexible since it must be capable of flexing from a straight line configuration as used during towing, as explained below, to take up substantially a right-angle bend while the installation is being put into service. This bend configuration becomes final when the latches $\mathbf{15}_3$ at the top to the bracket are actuated to fix the bottom end of the riser. Thereafter the bend shape of the first flexible pipe element remains substantially constant throughout the lifetime of the installation. In contrast, although the second flexible pipe element is likewise in a straight line configuration during turning, once the vertical riser has been put into position it allows the terminal portion of rigid pipe 13 to move relative to the axis YY' over only a limited cone of angle $\alpha$. The angle $\alpha$ is small, and in particular lies in the range 5° to 10°. However these angular movements need to be allowed continuously throughout the working lifetime of the installation, such that this second flexible pipe element must be dimensioned so as to withstand fatigue throughout the lifetime of the installation which may be as much as 20 years. Thus, the first flexible pipe element 12 presents very great flexibility so as to be capable of being flexed through 90° without being damaged, but it is subsequently hardly flexed at all throughout the lifetime of the installation, whereas the second flexible element 14 needs to deform through a few degrees only, but must be capable of doing so throughout the lifetime of the installation in response to movements due to swell and currents acting on the hybrid tower as a whole and also on the floating support, which represents several million cycles.

Figure 4:
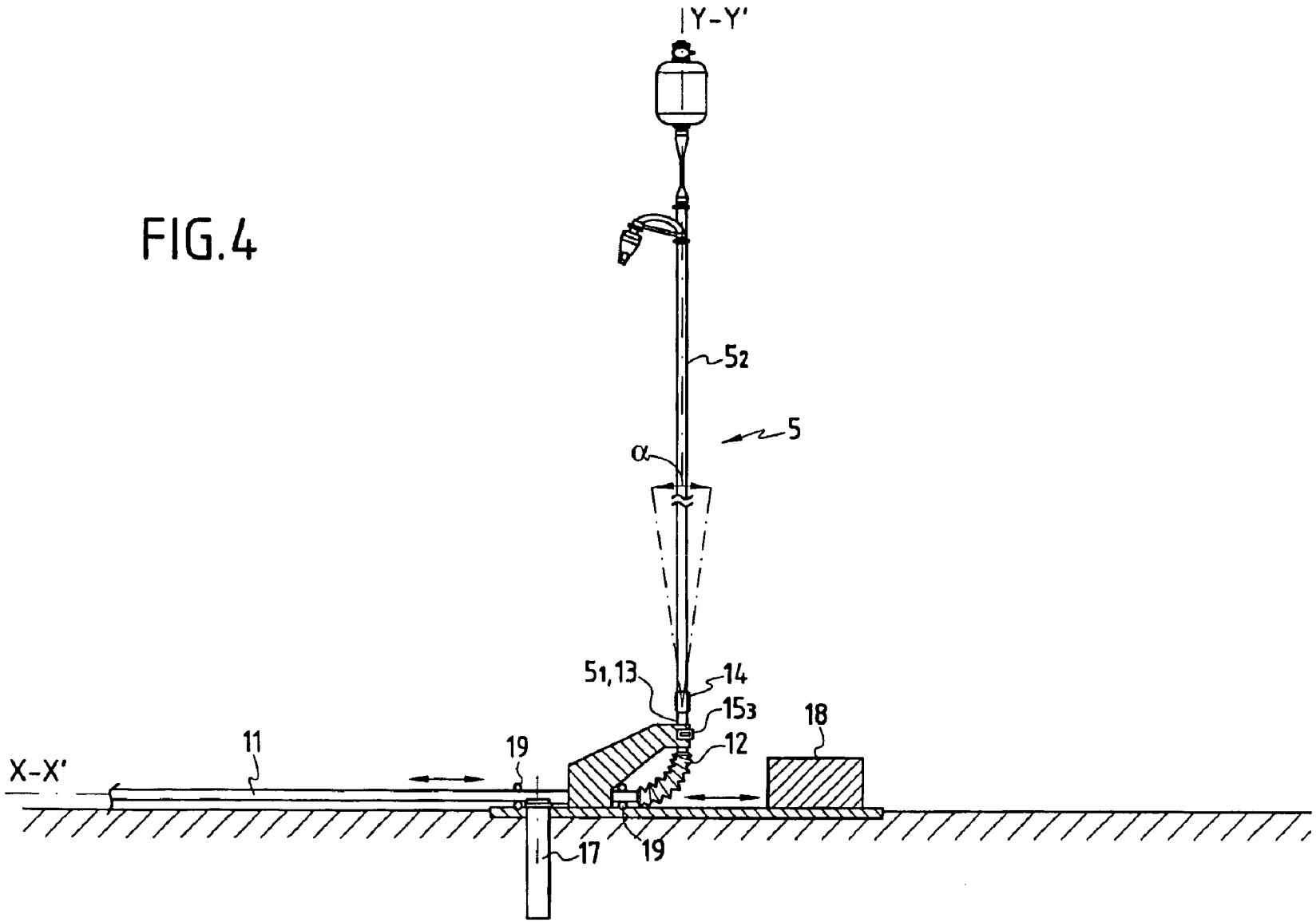
FIG. 4 is a side view of a tower of the present invention, in which the horizontal pipe resting on the sea bottom is free to move parallel to its axis relative to the base that is fixed on the bed.

FIG. 4 shows a preferred version of a hybrid tower installation of the invention in which the undersea pipe resting on the bottom is free to move in translation parallel to its own axis XX' through roller guides 19 secured to the base. Such guidance of the undersea pipe resting on the bottom enables it to move longitudinally along its axis so that said pipe 11 exerts practically no force on the base structure since any expansion of said undersea pipe 11 due to variations in the temperature and the pressure of the fluid inside it is absorbed by deforming the bend constituted by said first flexible pipe element. To accommodate such movements in translation of the undersea pipe 11, which may have an amplitude in the range 1 m to 2 m, the radius of curvature of said first flexible pipe element is greater in the embodiment of FIG. 4 than it is in the embodiment of FIG. 2, as shown in the drawings. In particular, in the embodiment of FIG. 2, the length of the first flexible pipe element lies in the range 7.5 m to 15 m, whereas in FIG. 4 it may lie in the range 12.5 m to 20 m. The first flexible pipe element 12 is subjected to movement only in the event of a significant variation in the operating temperature and pressure inside the pipes, and such variation remains exceptional. Given the greater length of the first flexible pipe element 12 in the second embodiment of FIG. 4, the base presents a superstructure that is dimensioned accordingly. For platforms of large dimensions, stability is advantageously increased by placing deadweight blocks 18 on the platform. The guide rollers 19 placed beneath the end of the undersea pipe 11 resting on the sea bottom present axes that are preferably parallel to said platform and that are supported-thereby, being disposed on either side of the base of the bracket.

Figure 11:
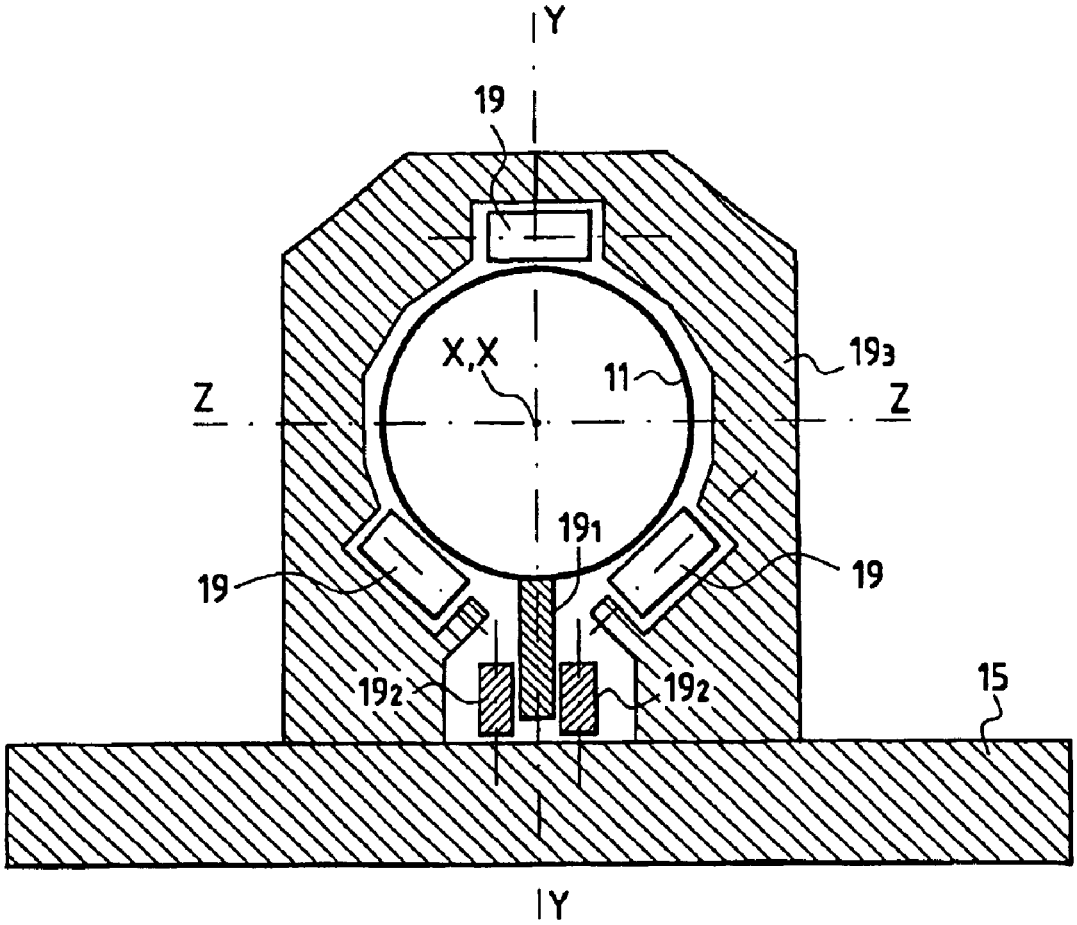
FIG. 11 shows means for guiding the end of the undersea pipe over the base, said guide means including anti-rotation devices.

FIG. 11 shows guide means 19 for the undersea pipe 11 resting on the bottom, in the form of sliding skids allowing longitudinal displacement in the direction XX' only, corresponding to the axis of said pipe, with displacement in the upward direction YY' then being impossible as are lateral displacements in a direction ZZ'. Naturally, it is also possible to replace the sliding skids with any other device for reducing friction.

The skids 19 are mounted around the pipe 11 by means of an assembly structure $\mathbf{19}_3$ surrounding said pipe.

The anti-rotation devices comprise:

firstly a bar $\mathbf{19}_1$ secured to the end of the pipe 11 and extending vertically down from its bottom face; and secondly sliding skids or rollers $\mathbf{19}_2$ secured to said base 15 and in sliding contact with said bar $\mathbf{19}_1$ on either side of said bar $\mathbf{19}_1$.

Thus, during displacement in longitudinal translation over the guide skids or rollers 19, any twisting of the end of the pipe about its own longitudinal axis XX' is prevented by the anti-rotation device $\mathbf{19}_1$, $\mathbf{19}_2$. The anti-rotation devices $\mathbf{19}_1$, $\mathbf{19}_2$ thus ensure that twisting phenomena applicable to said pipe about its own axis and of the kind that appear during expansion or contraction movements of the pipe under the effect of pressure or temperature are not transferred to said first flexible pipe element that takes up a bend shape.

In the method of installing an installation of the invention, the following steps are performed in succession:

1. The various elements making up the hybrid riser tower are prefabricated on land and the following are assembled end to end in succession:

the undersea pipe 11 that is to rest on the sea bottom;

the first flexible pipe element 12;

the terminal portion of rigid pipe 13 that is to constitute the bottom end of the vertical riser 5;

the second flexible pipe element 14; and the main portion $\mathbf{5}_2$ of the vertical riser 5.

Figure 5:
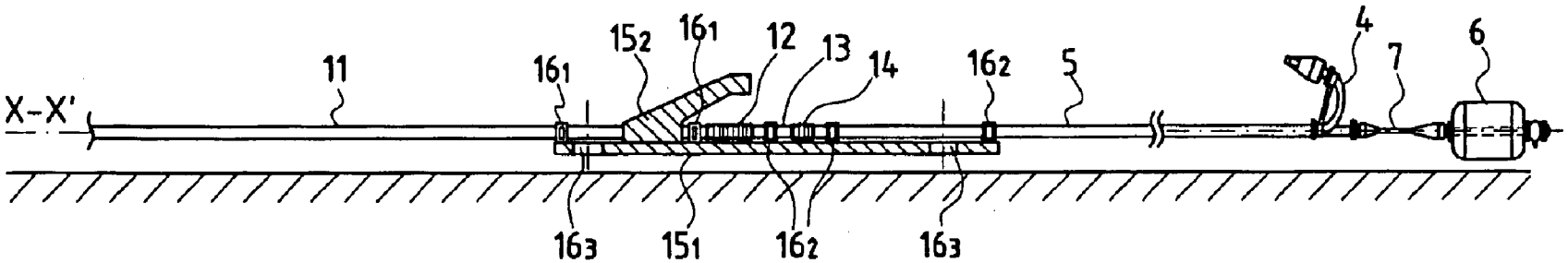
FIG. 5 is a side view of a single-tube hybrid tower shown close to the sea bottom while it is being towed to its installation site.

2. The base is put into place as shown in FIG. 5 which shows a hybrid tower while it is being towed to the site where it is to be installed. The base is secured to the end of the undersea pipe 11 that is to rest on the sea bottom via the rigid fixing supports $\mathbf{16}_1$ of the conventional clamping collar type, securing said pipe to said platform $\mathbf{15}_1$ on which it rests. These fixing supports are locked in definitive manner when installing an embodiment as shown in FIG. 2, or in temporary manner when installing an embodiment as shown in FIG. 4. Said terminal portion of the riser as constituted by the intermediate rigid pipe 13, and the top portion or main portion $\mathbf{5}_2$ of the riser that is to constitute the vertical riser 5 are also both secured to the platform $\mathbf{15}_1$ by means of temporary fixing supports $\mathbf{16}_2$ of the conventional clamping collar or flange type. The top end of the future vertical riser 5 is fitted during prefabrication on land with a swanneck 4, with a connection pipe 7, and with a suitably ballasted float 6. The towing cable (not shown) is connected, for example, to the end of the head float 6. The portion of flexible pipe 3 that provides the connection between the swanneck 4 and the floating support 1, as shown in FIG. 1, is advantageously folded along the rigid pipe that is to constitute the vertical riser 5, and is held securely by means of straps.

3. The assembly as made up in step 2 is pulled out to sea as the manufacture of the installation progresses.

4. At the end of manufacture, the set of elements making up the hybrid tower as built up in this way to constitute a continuous pipe is towed to the site for installation.

5. At the end of towing, the base structure is placed on the sea bottom in the target zone close to the future floating support 1. To do this, floats (not shown) that were being used to hold the installation at a certain height above the sea bottom during towing are flooded.

6. Said base is stabilized by means of suction anchor(s) 17 driven through the orifice(s) 163 of the platform, or by lowering deadweights 18 onto the platform. The suction anchor 17 is lowered using a hoist ring $\mathbf{20}_2$ until it penetrate into the seabed. An ROV (not shown) then makes a connection with an orifice $\mathbf{20}_3$ in the top end $\mathbf{20}_1$ and puts the inside of the bell under suction by means of a pump. The resulting force is considerable and urges the suction anchor into the seabed until an abutment $\mathbf{20}_4$ at its top end bears against the platform, thereby stabilizing it.

7. The temporary fixing supports $\mathbf{16}_2$ acting on said rigid pipe portions 13 and 5 are released as are the temporary fixing supports acting on the of the undersea pipe 11 that rests on the sea bottom, if it is held by temporary supports.

8. The portion of pipe that constitutes the future vertical riser 5 is put under tension merely by emptying the head float 6, e.g. by forcing in compressed air, or alternatively by hoisting from the installation ship 10 on the surface acting on the top end of the head float 6. Under such circumstances, the float is emptied using air after it has been hoisted, once the vertical riser 5 is already in a substantially vertical position.

9. The intermediate portion of rigid pipe 13 at the bottom end is secured by means of a latch $\mathbf{15}_3$ constituted by a conventional clamping collar or flange which secures it to the platform $\mathbf{15}_1$ of the base structure. Release of the temporary fixing support $\mathbf{16}_2$ and locking to the top of the bracket $\mathbf{15}_2$ are the only operations that need to be performed on the sea bottom. However these operations can be performed easily and quickly by means of an ROV.

10. The straps holding said flexible pipe 3 (not shown in FIG. 4) are released and the end of said flexible pipe 3 is then merely pulled from and towards the floating support 1 prior to being connected as shown in detail in FIG. 1. When the flexible connection pipe 3 is put into place and connected to the swanneck 4, coupling is performed by means of an automatic male-female type connector operated by an ROV, or else by means of a conventional flange installed by divers, if the depth of the water makes that possible.

Figure 6A:
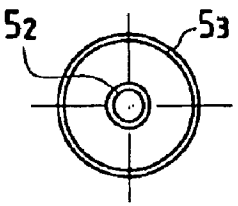
FIG. 6A is a section view showing the section of an inner pipe and an outer pipe of a vertical riser insulated by a "pipe-in-pipe" type configuration.

In its top portion above said second flexible pipe element 14, said vertical riser 5 comprises a system of pipes as shown in FIG. 6A, comprising a pipe-in-pipe thermal insulation system made up of two coaxial pipes comprising an inner pipe $\mathbf{5}_2$ and an outer pipe $\mathbf{5}_3$, with an insulating fluid or material $\mathbf{5}_4$ e.g. constituted by paraffin or by a gel preferably being located between said two pipes $\mathbf{5}_2$ and $\mathbf{5}_3$. In a preferred version, the space between said two pipes is occupied by a high vacuum.

Figure 6B:
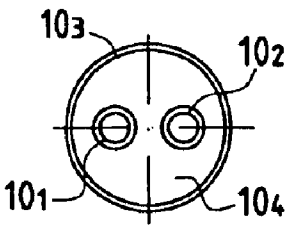
FIG. 6B is a section view through a bundle of two undersea pipes resting on the sea bottom.

In FIG. 6B, said two undersea pipes $\mathbf{11}_1$ and $\mathbf{11}_2$ resting on the sea bottom or constituting a portion of the vertical riser are assembled as a bundle within a common flexible protective casing $\mathbf{11}_3$ for circulating and confining an insulating material $\mathbf{11}_4$ around said pipe, the material preferably being paraffin or a gel.

Under such circumstances, one of the two pipes in the vertical bundle is fitted at its end with a second flexible pipe element 14 and then to the terminal portion of rigid pipe 13 which is secured to the top of the bracket $\mathbf{15}_2$ by means of the latch $\mathbf{15}_3$, said latch serving to transmit the vertical forces exerted on said vertical riser to the bracket and thus to the base and its anchor system. The second pipe in the vertical bundle is connected directly to the corresponding pipe of the bundle resting on the sea bottom by means of a pipe or a pipe of low rigidity, which pipe can either be free to move in three dimensions, or else can be constrained to pass through guides that limit the extent of its movements. Thus, the first pipe of the vertical bundle carries the vertical forces of the tower, with the second pipe then being free in three dimensions, or else constrained to pass through guides.

Figure 7:
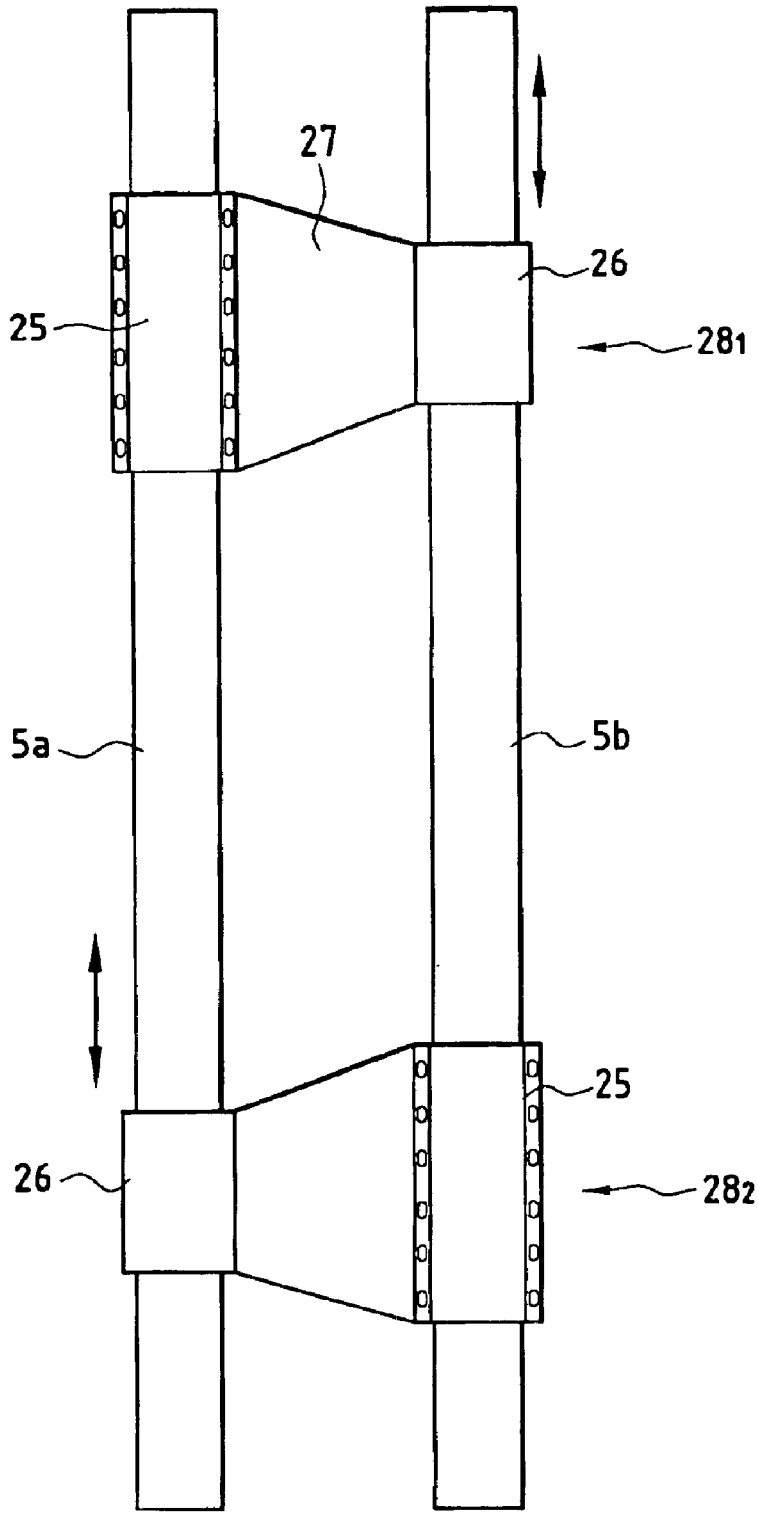
FIG. 7 is a side view of two vertical risers interconnected by sliding connection and guide means.

FIG. 7 shows in detail a preferred way of allowing one of the risers 5*a*, 5*b* to move axially relative to the other when they are not assembled together as a bundle, thus ensuring that differential expansion between the risers can be accommodated without giving rise to unacceptable stresses that would run the risk of damaging or even destroying the tower. The device of the invention is constituted by a tubular collar 25 firmly secured to the riser 5*a* and rigidly connected at 27 to a tubular ring 26 free to slide on the riser 5*b*. The collars are distributed along the risers at optionally regular intervals and they are preferably installed in opposition as shown in FIG. 7. Thus, with two risers both secured to the base via connections with said second flexible pipe element 14, if only the riser 5*a* is at a high temperature, then the sliding rings 26 allow said riser 5*a* to expand and nearly all of the expansion is then to be found at the head of the vertical riser at its swanneck as shown in FIG. 8.

Figure 8:
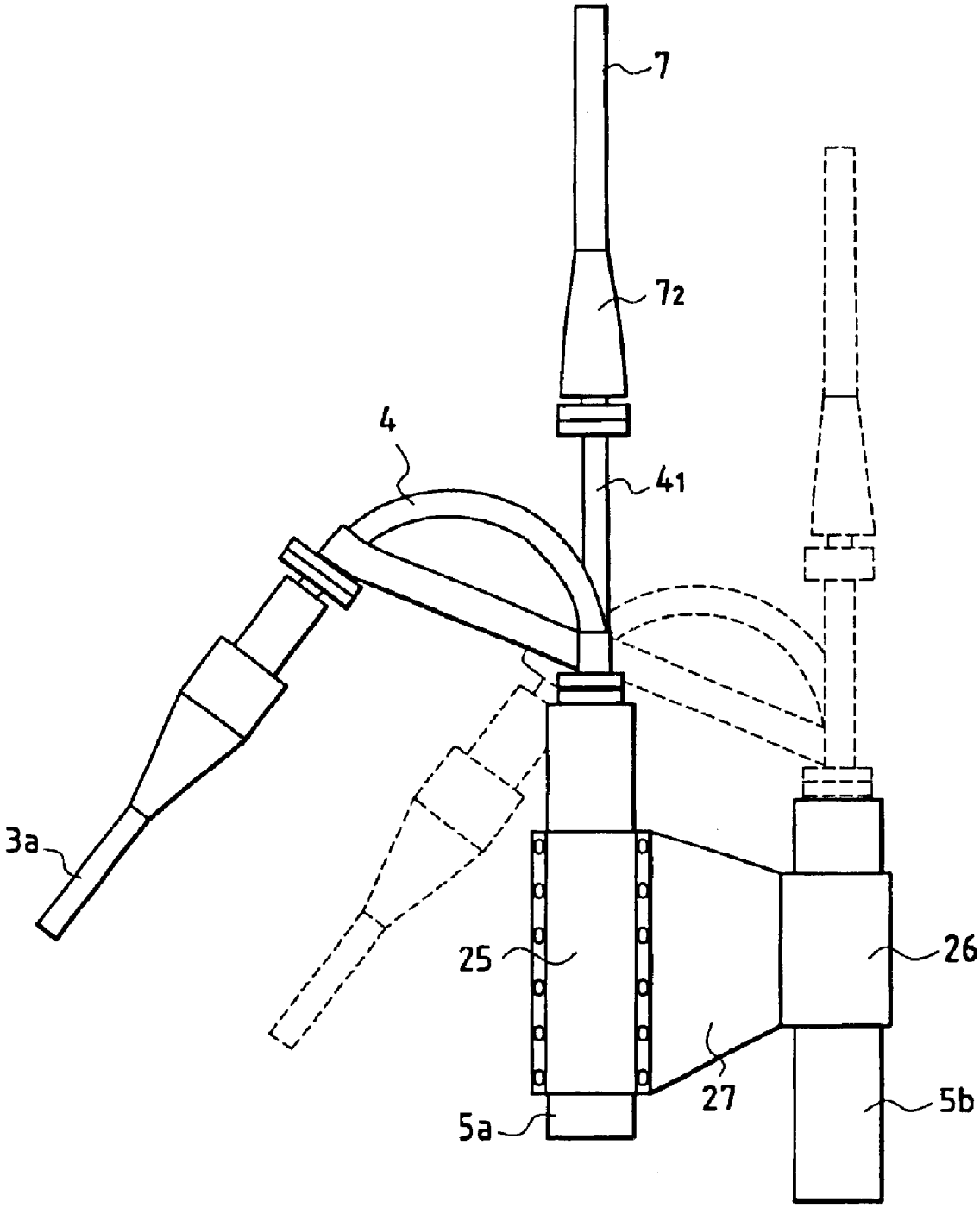
FIG. 8 is a side view of the top ends of vertical risers with respective swanneck type devices serving to connect them firstly to the floating support via respective pipes, and secondly to the floats.

In FIG. 8, the installation comprises a connection device 4, 7 between said float 6 and the top end of said riser 5, said device comprising:

a third flexible pipe 7 whose ends are fixed without hinge freedom both to the underside of said float 6 and to the top end of the riser 5;

the connection between said third flexible pipe 7 and the top end of said riser 5 is provided by means of a swanneck-shaped device 4 which swanneck-shaped device 4 also provides the connection between said riser 5 and one of said flexible pipes 3 leading to the floating support; and said third flexible pipe 7 is extended through said float 6 by a rigid tubular pipe 8 passing right through the float so that it is possible to take action on the inside of said vertical riser 5 from the top end of the float 6 via said rigid tubular pipe 8, after which said connection device constituted by said third flexible pipe 7 gives access via said swanneck-shaped device 4 to the inside of the said riser 5 enabling it to be cleaned by injecting liquid and/or by scraping the inside wall of said riser 5, and thus giving access to the undersea pipe 11 resting on the sea bottom.

At its ends, said third flexible pipe 7 presents elements $\mathbf{7}_1$, $\mathbf{7}_2$ for progressively varying the second moment of area of its cross-section where it joins respectively the underside of the float 6 and the top end $\mathbf{4}_1$ of the swanneck.

Figure 9:
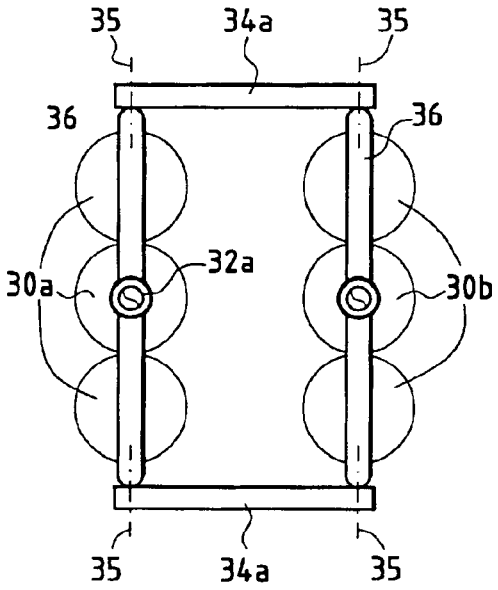
FIGS. 9 and 10 are respectively a plan view and a side view of floats situated directly in line with two vertical risers.

In FIG. 9, the installation of the invention comprises two groups, each comprising a plurality of floats 30*a*, 30*b* at the tops of said at least two vertical risers 5*a*, 5*b*. Said floats 30*a*, 30*b* in any one of said groups are held together and fixed to one another by means of a rigid structure in the form of a rectangular frame constituted by two parallel bars 33 that extend vertically and two parallel bars 36 that extend transversely, enclosing and supporting the floats. The two rectangular frames about the two groups of floats 30*a*, 30*b* are interconnected by two hinged parallelogram frames, one on each side, each parallelogram frame being constituted by two of the substantially vertical bars 33 which are interconnected at their respective ends by top and bottom transverse bars 34*a* and 34*b* that are parallel and that are connected thereto by hinges 35.

The assembly constitutes a parallelepiped that is deformable by said rectangular frames moving in vertical translation relative to each other, thus enabling each of said groups of floats to move vertically relative to the other, in particular as a result of differential expansion.

Figure 10:
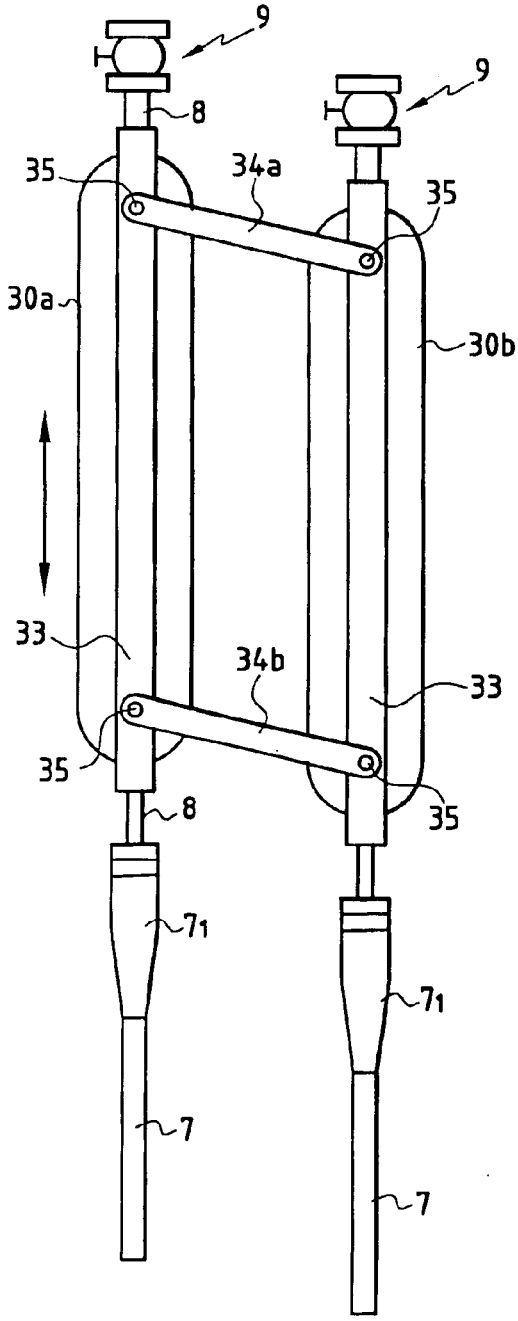

As shown in detail in FIGS. 9 and 10, the structure supports a group of three floats 30*a*, where the central float has a pipe 8 passing therethrough in continuity with said third pipe 7 and opening out via the top of said float through a leakproof orifice 9, e.g. comprising a ball valve. Thus, all of the maintenance operations on a riser and on a large fraction of pipe resting on the sea bottom can advantageously be performed from a surface vessel 10 located vertically above said axis valve 32*a*. A coiled tubing operation is possible in the fraction of pipe that rests on the sea bottom providing the radius of curvature of the bend at the base is large enough, e.g. 5 m or 7 m or even more.

In FIG. 8, since riser 5*b* is cold it is shorter than riser 5*a* which is at a higher temperature. Similarly, in FIG. 10 it can be seen that the group of floats 30*b* is offset downwards correspondingly. The two groups of floats 30*a*, 30*b* are kept substantially uniformly spaced apart by means of the parallelogram structures forming a vertically deformable parallelepiped, thus accommodating the resulting vertical displacements, e.g. due to differential expansion of the two risers 5*a*, 5*b*, one riser being hot while the other riser is at the same temperature as sea water, i.e. being cold.

The means for interconnecting the floats are described above as comprising bars 33, 34 hinged about axes 35, but they could also be constituted by deformable elements, e.g. made of elastomer, it being understood that the intended purpose is to keep the two groups of floats 30*a*, 30*b* at a substantially constant distance apart so as to ensure that they do not bang against each other because of the swell and currents, while nevertheless allowing them to move relative to each other in a direction that corresponds substantially to the axis of the vertical pipes.

In the same manner, FIG. 7 remains within the context of the invention even if the collars 25 and the sliding rings 26 for guiding the main fractions of the two vertical risers are replaced by hinged bars similar to those described above for guiding the floats 30.

What is claimed is:

1. A bottom-to-surface connection installation for an undersea pipe resting on the sea bottom, in particular at great depth, the installation comprising:

I) at least one vertical riser connected at its bottom end to at least one undersea pipe resting on the sea bottom, and at its top end to at least one float;

II) preferably at least one connection pipe also preferably a flexible pipe, providing a connection between a floating support and the top end of said vertical riser; and III) the connection between the bottom end of said vertical riser and a said undersea pipe resting on the sea bottom being provided by means of an anchor system comprising a base resting on the bottom, and wherein a) the bottom end of the vertical riser is connected to the end of the pipe resting on the sea bottom via at least a first flexible pipe element that is curved to form a bend; and b) said base comprises a platform resting on the bottom and a superstructure secured to said platform and holding in position both said end of the undersea pipe resting on the sea bottom and said vertical riser that is connected to said first flexible pipe element, whereby the end of said first flexible pipe element connected to the bottom end of the vertical riser is held in a position that is fixed relative to said base; and the axes of said ends of said undersea pipe resting on the bottom and of said vertical riser connected to said first flexible pipe element are preferably held in a common plane perpendicular to said platform.

2. An installation according to claim 1, wherein:

a) said vertical riser comprises a rigid terminal portion of pipe at its bottom end, which portion is connected to the top portion of said vertical riser via a second flexible pipe element, thus allowing said top portion to move through an angle ex relative to said rigid terminal portion of pipe; and b) said base comprises a superstructure which holds said terminal portion of rigid pipe of said vertical riser whose end is connected to said first flexible pipe element rigidly in a fixed position relative to the base.

3. An installation according to claim 1, wherein said base has fixing supports suitable for holding the end of said first flexible pipe element connected to the end of said undersea pipe resting on the bottom in a position that is fixed relative to the base.

4. An installation according to claim 1, wherein said base has guide elements which allow the end of said undersea pipe resting on the bottom to move in longitudinal translation along its own axis XX'.

5. An installation according to claim 4, wherein, said guide elements comprise rollers or sliding skids over which said end of the undersea pipe resting on the bottom can slide in longitudinal translation along the axis XX' of said end.

6. An installation according to claim 4, wherein said guide means include anti-rotation devices which prevent said end of said undersea pipe from turning about its said longitudinal axis.

7. An installation according to claim 1, said base comprising a said superstructure secured to a said platform, said superstructure forming a bracket standing up on said platform, said platform preferably being secured to said guide means preferably consisting in rollers distributed on either side of the bottom of said bracket resting on said platform, and said bracket having a latch in its portion that is above said platform so as to enable said bottom end of said riser to be locked in position.

8. An installation according to claim 1, wherein said base comprises a platform which co-operates with stabilizing elements comprising deadweights placed on said platform and/or suction anchors passing through said platform to be driven into the seabed.

9. An installation according to claim 1, including a connection device between said float and the top end of said riser, said device comprising:

a third flexible pipe element whose ends are connected in non-hinged manner respectively to the undersurface of said float and to the top end of said vertical riser; and the connection of said third flexible pipe to the top end of said riser taking place via a swanneck-shaped device, which swanneck-shaped device also provides the connection between said riser and a said connection pipe connected to the floating support, preferably a said flexible connection pipe;

said third flexible pipe preferably being extended through said float by a rigid tubular pipe passing right through the float so as to make it possible to take action on the inside of said vertical riser from the top portion of the float through said rigid tubular pipe, then through said connection device constituted by said third flexible pipe and then through said swanneck-device so as to access the inside of said riser and clean it by injecting liquid and/or by scraping the inside wall of said riser, and then said undersea pipe resting on the sea bottom.

10. An installation according to claim 1, comprising:

at least two of said vertical risers that are substantially parallel and close together, being connected at their top ends to at least one float;

at least two of said pipes resting on the sea bottom;

said base holding the bottom ends of said vertical risers in fixed position relative to the base; and said installation including at least two of said flexible pipe elements connecting the ends of the undersea pipes resting on the sea bottom to said bottom ends of said vertical risers.

11. An installation according to claim 1, wherein the at least two said undersea pipes resting on the sea bottom are assembled together as a bundle within a common flexible protective casing enabling an insulating material, preferably paraffin or a gel compound, to be confined around said undersea pipes.

12. An installation according to claim 10, wherein:

at least two of said undersea pipes resting on the sea bottom are assembled together as a bundle in a common flexible protective casing enabling an insulating material, preferably paraffin or a gel compound to be confined around said pipes; and at least two of said vertical risers are assembled together to constitute a bundle within a common flexible protective casing enabling an insulating material, preferably paraffin or a gel compound to be confined around said risers;

the connection of each individual pipe in the bundle between a pipe of the bundle resting on the bottom and the corresponding pipe in the vertical bundle being constituted by at least one of said first flexible pipe elements.

13. An installation according to claim 10, wherein a first vertical riser and a second vertical riser are held substantially parallel to each other by means of a sliding connection system allowing said first and second risers to move axially relative to each other, said connection system comprising a tubular collar fixed around said first riser, said collar being rigidly connected to a tubular ring that is free to slide on said second riser, and preferably a plurality of said collars of one sliding connection system on one of said risers being distributed in alternation along that riser with the rings of another said connection system on the other one of said risers.

14. An installation according to claim 10, including at least one float, preferably a group comprising a plurality of floats at the top of each of said at least two vertical risers, said floats being held together by means of a structure supporting them while allowing relative vertical displacements between said groups of floats relative to one other.

15. An installation according to claim 14, wherein said structure supporting said groups of floats comprises hinged structures forming parallelograms that are deformable in vertical translation.

16. An installation according to claim 1, wherein, in its top portion above said second flexible pipe element, said vertical riser comprises a system of insulated pipes made up of a set of two coaxial pipes comprising an inner pipe and an outer pipe, an insulating fluid or material or a vacuum being preferably located between said two pipes.

17. A method of installing an installation according to claim 1, the method comprising the following steps:

1) the following are preassembled in succession end to end: said pipe for resting on the sea bottom; said first flexible pipe element; said rigid pipe for constituting said vertical riser; and, where appropriate and preferably, said second flexible pipe element;

2) a said base is put into place co-operating with the assembly obtained in step 1), whereby said pipe for resting on the sea bottom and said rigid pipe for constituting said vertical riser are fixed to said platform, preferably close to the ends of said pipes that are connected to said flexible pipe elements; and the end of said first flexible pipe element connected to the bottom end of said vertical riser is not held by said superstructure of the base;

3) the assembly obtained after step 2 is towed to the desired site;

4) said base is put on the sea bottom and stabilized, preferably with said stabilizing elements;

5) said base is separated from said riser; and 6) said bottom end of said riser is connected with said superstructure of the base so as to be held in said fixed vertical position relative to the base.

* * * * *